US011738532B2

(12) United States Patent
Staerck

(10) Patent No.: US 11,738,532 B2
(45) Date of Patent: Aug. 29, 2023

(54) STACK OF FLEXIBLE BAGS, METHOD AND MACHINE FOR PRODUCING SAID STACK

(71) Applicant: HOLWEG GROUP, Molsheim (FR)

(72) Inventor: Frédéric Staerck, Erstein (FR)

(73) Assignee: Holweg Group, Molsheim (FR)

( * ) Notice: Subject to any disclaimer, the term of this patent is extended or adjusted under 35 U.S.C. 154(b) by 317 days.

(21) Appl. No.: 16/763,598

(22) PCT Filed: Nov. 12, 2018

(86) PCT No.: PCT/EP2018/080932
§ 371 (c)(1),
(2) Date: May 13, 2020

(87) PCT Pub. No.: WO2019/096738
PCT Pub. Date: May 23, 2019

(65) Prior Publication Data

US 2020/0361171 A1 Nov. 19, 2020

(30) Foreign Application Priority Data

Nov. 16, 2017 (FR) ..... 1771221

(51) Int. Cl.
*B31B 70/98* (2017.01)
*B31B 70/62* (2017.01)
(Continued)

(52) U.S. Cl.
CPC ..... *B31B 70/988* (2017.08); *B31B 70/62* (2017.08); *B65D 33/001* (2013.01);
(Continued)

(58) Field of Classification Search
CPC ..... B65D 27/00; B65D 33/18; B65D 1/34; B65D 85/62; B65D 33/20; B31B 19/62;
(Continued)

(56) References Cited

U.S. PATENT DOCUMENTS 4,502,599 A * 3/1985 Perecman ..... B65D 33/001 383/81
6,142,302 A 11/2000 Requena

FOREIGN PATENT DOCUMENTS

FR 786 579 A 9/1935
FR 1 270 400 A 8/1961
(Continued)

OTHER PUBLICATIONS

Machine translation of JP-2002308295-A.*
(Continued)

*Primary Examiner* — Andrew M Tecco
*Assistant Examiner* — Jacob A Smith
(74) *Attorney, Agent, or Firm* — Pearne & Gordon LLP

(57) ABSTRACT

Bags are made, with which a stack is formed. To do this, a tube is formed with a strip of flexible material, a portion of tube is separated at the front of the tube forming a first flap at the rear of the portion of tube, the first flap prolonging the first wall of the portion beyond the end of the second wall adjacent to the first wall, a bag is formed with each portion of tube, and a stack of bags is formed, the first wall of the first of the bags being against the second wall of the adjacent second bag. An anti-adhesive coating is applied on to the first wall of the first bag and a coat of adhesive is applied on to the second wall of the second bag ensuring the temporary attachment with the anti-adhesive coating.

6 Claims, 2 Drawing Sheets

(51) Int. Cl.

| | |
|---|---|
| ***B65D 33/00*** | (2006.01) |
| ***B65D 33/16*** | (2006.01) |
| *B31B 150/10* | (2017.01) |
| *B31B 150/00* | (2017.01) |
| *B31B 170/10* | (2017.01) |
| *B31B 160/10* | (2017.01) |

(52) U.S. Cl.
CPC .... *B65D 33/1691* (2013.01); *B31B 2150/003* (2017.08); *B31B 2150/10* (2017.08); *B31B 2160/102* (2017.08); *B31B 2170/10* (2017.08)

(58) Field of Classification Search
CPC ..... B31B 70/988; B31B 70/62; B31B 150/10; B31B 2150/003; B31B 2170/10
USPC ..... 493/204, 194
See application file for complete search history.

(56) References Cited

FOREIGN PATENT DOCUMENTS

| | | | | | |
|---|---|---|---|---|---|
| JP | H02-32952 | A | | 2/1990 | |
| JP | H0232952 | A | * | 2/1990 | ..... B65D 27/00 |
| JP | 2002-308295 | A | | 10/2002 | |
| JP | 2002308295 | A | * | 10/2002 | ..... B65D 33/18 |

OTHER PUBLICATIONS

International Search Report dated Jan. 15, 2019 for corresponding International Application No. PCT/EP2018/080932.
Written Opinion dated Jan. 15, 2019 for corresponding International Application No. PCT/EP2018/080932.
French Search Report dated Jul. 4, 2018 for corresponding French Application No. 1771221.
English translation of previously cited JPH02-32952 and Certificate of Translation of same.

* cited by examiner

STACK OF FLEXIBLE BAGS, METHOD AND MACHINE FOR PRODUCING SAID STACK

CROSS-REFERENCE TO RELATED APPLICATIONS

This is a National Stage application of PCT international application PCT/EP2018/080932, filed on Nov. 12, 2018, which claims the priority of French Patent Application No. 1771221, filed Nov. 16, 2017, both of which are incorporated herein by reference in their entirety.

FIELD OF INVENTION

The invention concerns packaging bags made of a flexible material such as paper or plastic film, or an assembly of the two, the bags being grouped together in the form of a stack. It also concerns a process and a machine designed for manufacturing said bags and stacking them.

PRIOR ART

In the area of packaging, notably food packaging, flat bags made of a flexible material are widely used to sell foodstuffs such as bread, fruit, vegetables and loose produce. Such bags are often mostly made of paper that is more or less thick, but which may also include synthetic plastic materials, that may be transparent.

Such a bag as per one of the known manufacturing techniques comprises a first wall and a second wall bonded together directly or by means of bellows along a longitudinal direction. At one end of the bag in the longitudinal direction, the first wall is prolonged by a first flap that protrudes beyond the second wall. At the other end, a second flap extending from the second end is folded, turned back and bonded to the first wall in order to form the bottom and thus close the end of the bag.

In another production method, the second flap also extends out of the first wall, in such a way that when both flaps are folded, they are folded back over the second wall, leaving the first wall free. In this case the term pouch bag is used. Envelopes are also made in the same way. Hereinafter, the term "pouch bag" will also designate an envelope.

In certain uses, the first flap can be bonded onto the second wall to close the bag or envelope. One of the techniques used consists of providing a coat of adhesive on the second wall and protecting it with a silicon-coated paper protective strip in such a way that it is not adhesive. When used, the protective strip is removed and the first flap is folded over and pressed against the coat of adhesive in such a way as to close the end of the bag or envelope.

In order to make such bags industrially, one known technique consists of forming a tube from a continuous sheet in a roll, separating sections from this tube and closing one end of the section to form a bag. The tube may also be made with a part made of plastic material, possibly transparent, assembled by bonding with the paper by overlapping the respective edges.

Document FR 786 579 shows several examples using this technique. The paper strip has transversal lines of perforations at regular intervals.

The tube is formed by folding each edge over the central part and bonding the two edges together along the central junction. The tube thus formed and flattened passes between a pair of drive rollers which drive the tube at a constant speed. The tube passes between a pair of separation rollers rotating with a peripheral speed higher than that of the drive rollers before being driven to a folding device. One of the rollers in the pair of separation rollers is hollowed out on a large part of its periphery so that it only comes into contact with the other roller intermittently. At the time of this contact, the tube is tautened between the drive rollers and the separation rollers in such a way as to obtain the separation of one section of the tube at the level of the perforations disposed in such a way that the first flap is formed in the prolongation of the first wall going towards the rear of the section and the second flap remains at the front of the tube in the prolongation of the second wall. This second flap will then be placed over the next section. The front part of the section that has just been separated is then gripped by the folding device. The second flap is coated with adhesive and folded by the folding device to close the front part of the section. The folding device brings the finished bag into the upright position on a table on which the bags accumulate and form a stack of separate bags.

Other examples of processes and machines used for producing such bags can be seen in document FR 1 270 400 A1 (pouch only).

The stack of bags is intended for manual use, which meets the greater part of the demand. However, certain uses require a high degree of productivity. In the case of closable bags that have an adhesive protected by a peel-off strip, the strip can only be grasped by hand, which is a delicate operation. Furthermore, it is necessary to dispose of the strip which forms a waste product.

Document U.S. Pat. No. 4,502,599 shows a stack of flexible bags, preferably made of plastic, that has a repositionable adhesive on a flap, making it possible to keep the bag closed after the flap has been folded over. In the stack, the adhesive adheres to the back of the adjacent bag's flap. Such a stack of bags facilitates repetitive packaging operations. The withdrawal of a bag from the end of the stack makes it possible to disengage the coat of adhesive by unsticking it from the anti-adhesive coating. The bag can then be used directly, without requiring any specific operation for releasing the coat of adhesive. Once filled, the bag can be closed by pressing the first flap on to the coat of adhesive. However, this technique can only be used for bags with a repositionable adhesive, and does not make it possible to obtain definitive closing.

OBJECT OF THE INVENTION

In order to solve these problems, the invention aims to provide a stack of closable bags enabling productive use. Another object is to provide a process and a machine for producing such a stack of bags.

DESCRIPTION OF THE INVENTION

With these goals in mind, the purpose of the invention is to provide a stack of flexible bags where each bag has a first flexible wall prolonged by a first flap at one end of the bag and a second flexible wall adjacent to the first wall, and from which extends the first flap, the stack being characterised by the fact it includes a means of attachment between each bag, the means of attachment including an anti-adhesive coating on the first wall of the first bag and a coat of adhesive ensuring a temporary bonding with the anti-adhesive coating and which also adheres to the second wall of the bag adjacent to the first bag, the coat of adhesive being able to bond the first flap to the second wall after the bag is detached from the stack.

Such a stack of bags opens up new perspectives for facilitating repetitive packaging operations. On the one hand, the removal of a bag from the end of the stack makes it possible to free the coat of adhesive by separating it from the anti-adhesive coating. The bag can then be used directly without requiring any specific operation to release the coat of adhesive. Once filled, the bag can be closed by pressing the first flap on to the adhesive coating. On the other hand, by pulling the bag off the stack, a separation is created between the first and second walls, opening the bag and making it ready to receive the object to be packed, possibly even before being detached from the stack. For example, the adhesive may be a pressure-sensitive acrylic adhesive supplied by Henkel under the name Euromelt 707 or Technomelt EM 707, or Technomelt PS 8707. Other adhesives from the same supplier are also suitable, such as Henkel Technomelt PS 578 for example. This adhesive is applied hot, between 150 and 180° C. Typically, the anti-adhesive coating is based on a silicon polymer.

In a first production method, the anti-adhesive coating is provided by a strip applied to the first wall. The anti-adhesive coating can thus be formed on a substrate which is placed on and bonded to the wall of the bag. This therefore gives a large choice of anti-adhesive coatings, which can just be placed on the required surface, the quality of the first wall being kept over the greater part of its surface.

With a second production method, the anti-adhesive coating extends over the whole surface of the first wall. This means there is no need for an operation or a device for applying the added strip.

As per an improvement, the stack of bags includes separators separating a predetermined number of bags. In addition to serving as a marker, facilitating the counting of the bags, the separators can serve as supports for facilitating handling of the stack.

As per a variant, the coat of adhesive is made with a repositionable adhesive. The bag can then be opened and closed several times by the user.

As per another variant, the adhesive coating is made with a definitive adhesive. This therefore ensures secure closing of the bag, as the bag must be torn in order to open it.

The object of the invention is also a bag manufacturing process used to form a stack such as described previously, whereby a tube is formed with a strip of flexible material, a portion of the tube is separated at the front of the tube forming a first flap to the rear of the portion of tube, the first flap prolonging a first wall of the portion beyond the end of a second wall adjacent to the first wall, and a bag is formed with each portion of tube by closing the front of the portion of tube, and a stack of bags is formed, the first wall of the first of the bags being against the second wall of the second, adjacent bag attached to the first bag by means of attachments, characterised by the fact an anti-adhesive coating is applied before the stack is formed on to the first wall of the first bag and a coat of adhesive is applied on to the second wall of the second bag ensuring a temporary attachment with the anti-adhesive coating and thus forming the means of attachment, the coat of adhesive being able to bond the first flap on to the second wall after the bag is detached from the stack.

Here we resume the conventional flat bag manufacturing process, in which we add a step to apply an anti-adhesive coating and a step to apply a coat of adhesive which are joined to form the stack of bags such as described previously.

According to a first way of accomplishing the process, the bag is closed by bonding a second flap extending from the second wall on to the first wall, the coat of adhesive is applied to the anti-adhesive coating before the stack is formed, and the coat of adhesive is transferred on to the second wall of the adjacent bag when the stack is being formed. This configuration concerns bags whose flaps are in the prolongation of different walls. With the known folding devices, we drive the sections on to a drum and move a transversal blade closer which pushes the second flap into a groove in order to fold the flap. Some adhesive is applied beforehand on to the wall opposite the one prolonged by the second flap. The second flap is then folded over in the continuation of the drum's rotation and is placed in contact with the adhesive-coated surface, thus bonding the second flap and closing the bottom of the bag. The second flap is therefore still in the prolongation of the wall that comes into contact with the drum on the latter's upper part, so it can apply adhesive to the opposite wall and perform the folding.

In the first accomplishment mode, the wall opposite the one that prolongs the first flap is the first wall that must receive the anti-adhesive coating. However, it is not possible to envisage applying adhesive to the second wall upstream of the drum because the bags are supported by this second wall during their conveyance. The coat of adhesive would inevitably come into contact with rollers or belts used for this conveying, which would cause the bags to stick to those parts which is not acceptable. So, it is proposed to apply the coat of adhesive to the anti-adhesive strip which is facing upwards, and that it should be transferred to the second wall and adhere to it when the bags are being stacked.

As per a first variant, we apply a strip comprising an attachment coating, a substrate, the anti-adhesive coating and the coat of adhesive on to the first wall, the strip being deposited on the first wall on the attachment coating side. The anti-adhesive coating and the coat of adhesive are deposited simultaneously which makes it possible to use a single device for applying the anti-adhesive coating and the coat of adhesive. The strip is prepared specifically for the application, by depositing on the substrate the attachment coating on one of the faces, and the coat of adhesive on the other face which supports the anti-adhesive coating. This strip is handled by rollers with an anti-adhesive treatment that comes into contact with the face supporting the coat of adhesive and which deposits the strip on the wall of the bag. The adherence properties are chosen in such a way that the strip remains bonded to the wall by the attachment coating and that the coat of adhesive separates from the rollers that carry it and remains on the strip.

As an option, the coat of adhesive is protected by a silicon-coated protection sheet which makes it possible to press on the strip at the time of application and which is removed just afterwards.

As per a second variant, a strip comprising an attachment coating, a substrate and the anti-adhesive coating is deposited on the first wall, and in the next step the coat of adhesive is applied on to the anti-adhesive coating. This variant makes it possible to use a more standard type of self-adhesive strip with the corresponding installation device and leave the choice of the nature of the adhesive for the coat of adhesive.

According to a second accomplishment method, the bag is closed by bonding a second flap extending from the first wall on to the second wall, the coat of adhesive is deposited on the second wall and the anti-adhesive coating on the first wall, the coat of adhesive and the anti-adhesive coating being joined when the stack is formed. This accomplishment method concerns pouch bags or envelopes. The anti-adhesive coating can be applied to the strip of flexible material before the formation of the tube, or to the tube before it is separated into sections or to the sections. The coat of adhesive can be applied just upstream of the folding device, by the modified folding device itself upstream or downstream of the folding operation.

According to a variant, a coat of adhesive is deposited upstream of the closing of the bottom of the bag. Depending on the existing machines that are to be adapted in order to implement this process, it may be interesting to apply the adhesive at this stage of the process.

The object of the invention is also a machine for manufacturing flexible bags comprising a tube formation device to form a tube from a strip of flexible material, a separation device for separating a portion of the tube at the front of the tube by forming a first flap at the rear of the portion of tube, the first flap prolonging a first wall of the portion beyond the end of a second wall adjacent to the first wall, a device for forming the bottom to make a bag with each portion of tube by closing the front of the portion of tube, and a stacking device for forming a stack of bags, the first wall of the first of the bags being against the second wall of a second adjacent bag, the machine being characterised by the fact it comprises the first means of application for applying an anti-adhesive coating to the first wall of the first bag and a second means of application for applying a coat of adhesive on to the second wall of the second bag in such a way that the coat of adhesive is opposite the anti-adhesive coating when the bags are stacked.

BRIEF DESCRIPTION OF THE FIGURES

Other advantages may well become apparent to an expert in the field on reading the examples below, illustrated by the appended figures, given as an illustration, amongst which.

DETAILED DESCRIPTION

Figure 1:
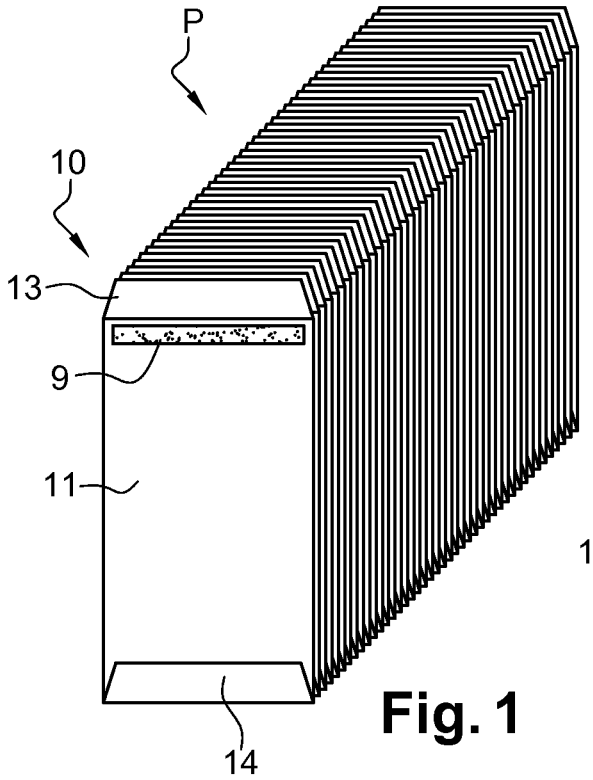
FIG. 1 is a perspective view of a stack of bags conforming to a first accomplishment method using the invention.
Figure 3:
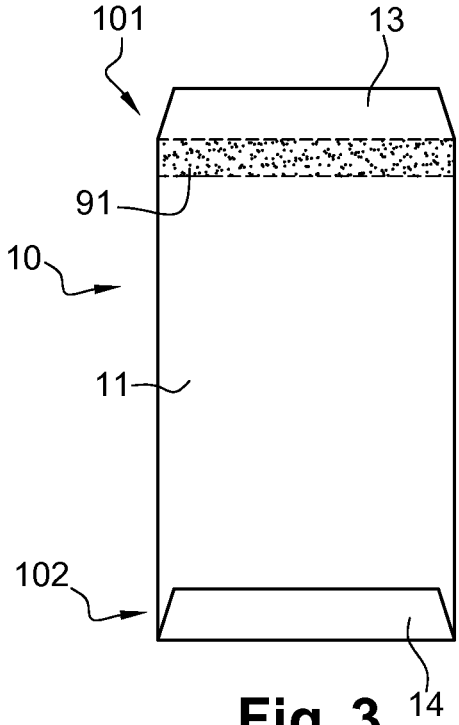
FIG. 3 is a view of a bag taken from the stack in FIG. 1, seen from the first face side.
Figure 4:
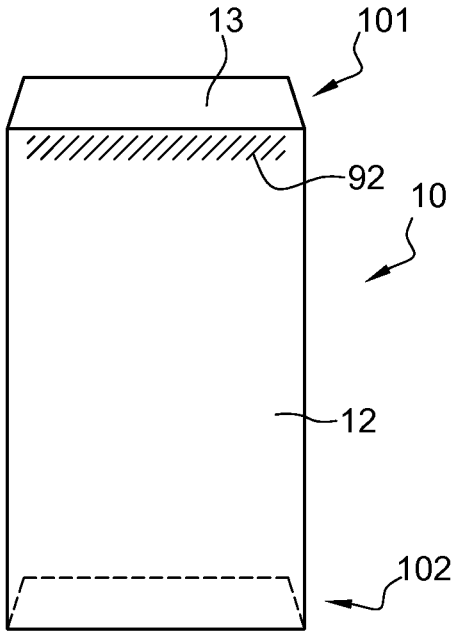
FIG. 4 is a view of the bag in FIG. 3, seen from the second face side.

A stack P of 10 flexible bags as per a first accomplishment method of the invention, is shown in FIG. 1. As shown in FIGS. 3 and 4, each bag 10 in stack P comprises a first flexible wall 11 prolonged by a first flap 13 at the first end 101 of the bag 10 and a second flexible wall 12 adjacent to the first wall 11 and from which protrudes the first flap 13. Bag 10 also comprises a second flap 14 extending from the second wall 12 folded and bonded on to the first wall 11 to close the bag 10 at the second end 102, opposite the first end 101, as shown in FIG. 3.

Stack P comprises means of attachment 9 between each bag 10. These attachment means 9 comprise an anti-adhesive coating 91 on the first wall 11 of the first bag 10, such as shown in FIG. 3, and a coat of adhesive 92 ensuring a temporary attachment with the anti-adhesive coating 91 and which also adheres to the second wall 12 of the bag 10 adjacent to the first bag 10, as shown in FIG. 4. The coat of adhesive 92 is able to bond to the first flap 13 on the second wall 12 after the bag 10 has been detached from stack P in order to close the first end 101 of bag 10.

Figure 6:
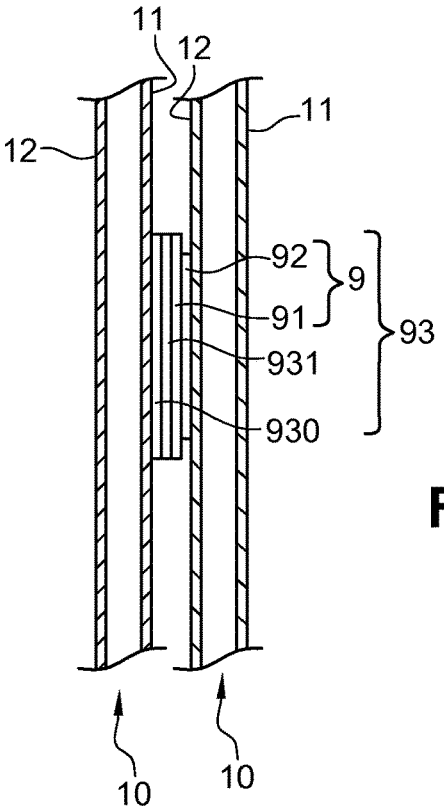
FIG. 6 is a partial section view of the stack in FIG. 1.

The anti-adhesive coating 91 is, for example, supported by a strip added to the first wall 11, as shown in FIG. 6.

Figure 2:
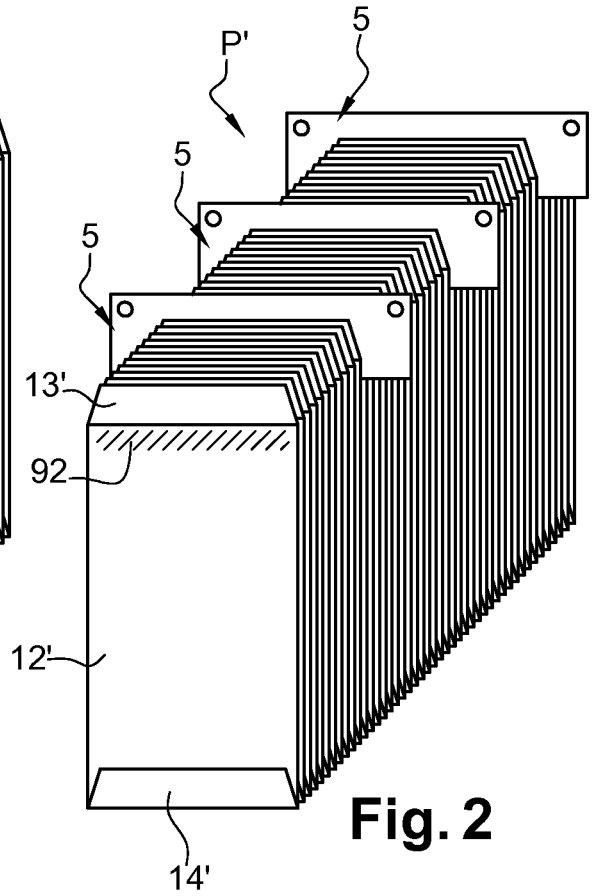
FIG. 2 is a view similar to FIG. 1 of a stack of bags conforming to a second accomplishment method.

In a second accomplishment method of the invention, the stack P' includes separators S separating a predetermined number of bags 10', as shown in FIG. 2. Each separator is attached by bonding on to one of the bags next to it. In this example, the bags 10' are envelope bags, that is to say the first 13' and second flaps 14' extend from the first wall, with only the second wall 12' being visible in FIG. 2.

The coat of adhesive 92 can be made with a repositionable adhesive or a permanent adhesive.

Figure 5:
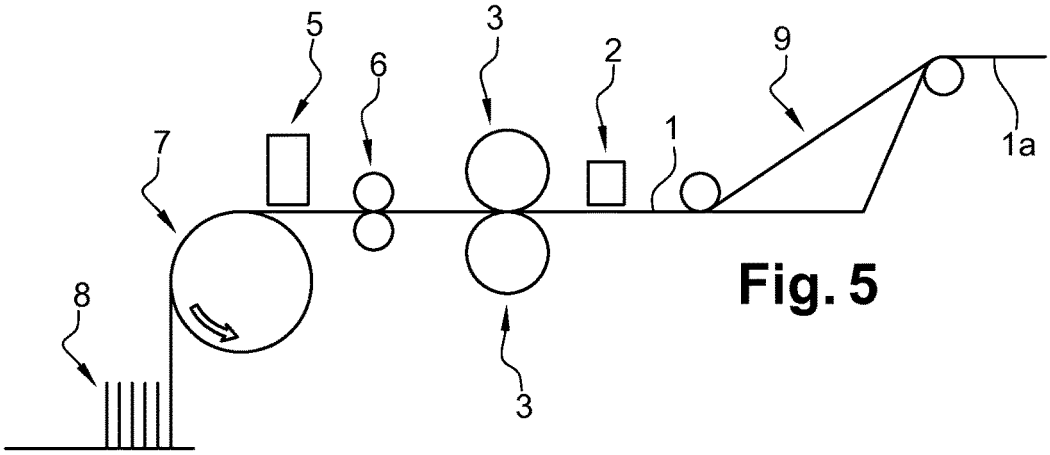
FIG. 5 is a schematic view of a machine for manufacturing a stack of bags conforming to the invention's first accomplishment method.

A machine for making stacks P of bags 10, such as shown in FIG. 5, includes in a manner known per se a station 4 for forming a tube 1 from a strip of flexible material la such as raw or pre-printed paper, an aluminium or plastic film or equivalent, or a combination of these materials. The strip of material la is unreeled from a reel on to a spool, not shown. It can be printed beforehand or at the output from the spool. The tube 1 is formed with or without bellows, but this characteristic does not have any impact on the invention. The machine then successively includes, in the tube 1 conveyance direction shown by arrow Fl, a pair of gripping rollers 3, a pair of tear-off rollers 6, a bag-bottom forming station 7 and then a stacking station 8 for forming the stack P of bags 10.

In order to specifically implement a process as per the invention, the machine also includes a first means of application 2 for applying the anti-adhesive coating 91 and a second means of application 5. The first means of application 2 may, for example, be provided to apply a strip 93 of self-adhesive silicon-coated paper, that is to say including an attachment coat 930 which is brought into contact with the tube 1 to be applied to it. In an example not shown, some adhesive is first of all applied to the tube, then the silicon-coated strip 93 is applied to the adhesive-coated area so it can adhere to it, the anti-adhesive face 91 remaining visible. Document GB390455 shows an example of a process for applying a paper reinforcement to a tube that can be used here for applying the anti-adhesive strip.

For example, the strip 93 includes the attachment coating 930, a substrate 931 and the anti-adhesive coating 91, the strip 93 being applied to the first wall 11 on the same side as the attachment coating 930.

The second means of application 5 is provided to apply a coat of adhesive 92 to the silicon-coated strip, that is to say to the anti-adhesive coating 91.

The functioning of the machine has now been broadly outlined, the detail of manufacturing a bag 10 already being known. The strip of flexible material la, including transversal lines of perforations at regular intervals, is unreeled then formed into a tube 1. The tube 1 receives the anti-adhesive coating 91 by the first means of application 2 on a first wall 11 of the tube and is then separated into sections lb at the front of the tube 1 by the combined action of the pairs of gripping rollers 3 and tear-off rollers 6, in a manner known per se. The separation is made along the lines of perforations that have been made in such a way that the first flexible wall 11 of the tube 1, in the upper part, is prolonged by a first flap 13 at the first end 101 of the bag 10 towards the back of the section, and a second flap 14 prolongs the second wall 12, in the lower part of the tube at the second end 102 towards the front of the section. A coat of adhesive 92 is applied to the anti-adhesive coating 91 by the second means of application 5. In a manner known per se, the second flap 14 is folded on to the first wall 11 and bonded to close the bag 10 by the bag-bottom forming device 7. Finally, the bags 10 arrive at the stacking station 8 where they are stopped in the upright position, the first wall 11 of bag 10 that arrives placing itself along the second wall 12 of the preceding bag 10. When the bags 10 are thus side by side, the coat of adhesive 92 carried by the anti-adhesive coating 91 comes into contact with the second wall 12 of the preceding bag 10 and adheres to it. As per the invention, the stack P is thus formed.

Figure 7:
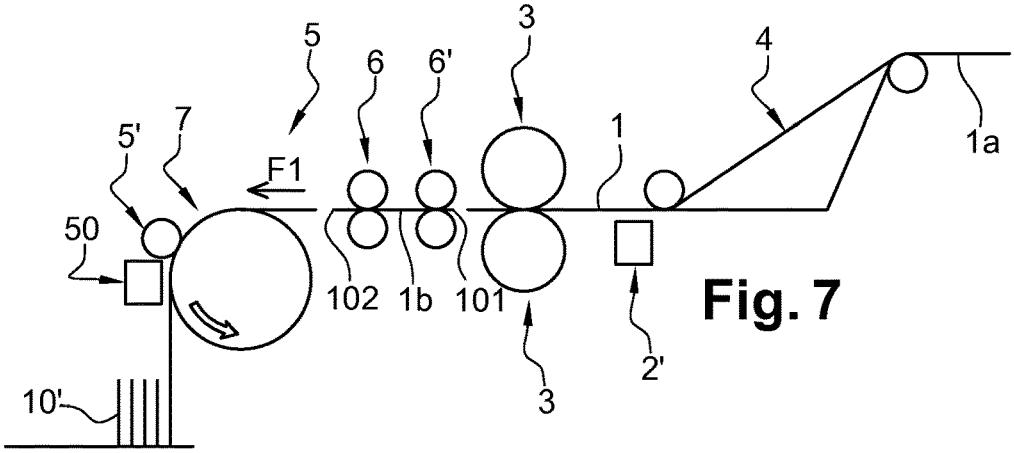
FIG. 7 is a view similar to FIG. 5 of a machine for manufacturing a stack of bags conforming to the invention's second accomplishment method.

In a second accomplishment method of the invention, the bags 10' are of the envelope type, also called pouch bags, that is to say that both the flaps prolong the first wall, as shown in FIG. 2. In the manufacturing process known for this type of bag 10', the first wall is in the lower position, and the second wall 12' in the upper position. The machine, as shown in FIG. 7, is modified by the insertion of an additional pair of rollers 6' between the pairs of gripping rollers 3 and of tear-off rollers 6, and an additional tear-off step removes the waste at the first end 101 of the section of tube lb in order to form the first flap 13' prolonging the first wall in the lower position.

In this configuration, the first means of application 2' acts on the first wall, in the lower position therefore, to apply the anti-adhesive coating 91, whereas the second means of application 5' still acts on the upper part, to apply the coat of adhesive 92 on the second wall 12'. When the bag 10' arrives at the packing station, the preceding bag 10' presents its first wall 11, with the anti-adhesive coating 91 applied, which assembles with the coat of adhesive 92 on the second wall 12' of the bag 10' which arrives to form the means of attachment 9. The separators S are deposited intermittently on the bag downstream of the bag-bottom forming device 7 by a third means of application 50.

The invention is not limited to the accomplishment modes that have been described to serve as examples. The second means of application could be integrated in the bag-bottom forming device 7 in order to apply the coat of adhesive 92 at the latest possible time in the progression of bag 10. Likewise, the first means of application 2 could be placed after the tear-off rollers 6 or also integrated in the bag-bottom forming device 7. In this case, the strip that is applied to the first wall 11 may include the attachment coating 930, the substrate 931, the anti-adhesive coating 91 and the coat of adhesive 92, the strip being applied to the first wall 11 on the attachment coating side. In order to make it possible to handle the strip, the latter is protected by a protection sheet that is removed after application of the strip on to the tube section. The bags presented are flat, but they could just as well have side bellows, formed when the tube is formed.

The invention claimed is:

1. A bag manufacturing process for forming a stack whereby a tube is made with a strip of flexible material, a portion of the tube is separated at a front of the tube forming a first flap at a rear of the portion of the tube, the first flap prolonging a first wall of the portion of the tube beyond an end of a second wall of the portion of the tube adjacent to the first wall, a bag is formed with each portion of the tube by closing a front of the portion of the tube, and a stack of bags is formed, a first wall of a first bag of the stack of bags being against a second wall of an adjacent second bag attached to the first bag by means of attachment, wherein an anti-adhesive coating is applied to the first wall of the first bag and a coat of adhesive is applied to the second wall of the second bag ensuring a temporary attachment with the anti-adhesive coating and thus forming the means of attachment, the coat of adhesive being able to bond a first flap on to the second wall after the bag has been detached from the stack, wherein the bag is closed by bonding a second flap protruding from the second wall on to the first wall, the coat of adhesive is applied to the anti-adhesive coating before the formation of the stack, and the coat of adhesive is transferred on to the second wall of the adjacent second bag when the stack is formed.

2. The process according to claim 1 whereby a strip comprising an attachment layer, a substrate, the anti-adhesive coating and the coat of adhesive, is applied to the first wall, the strip being applied on to the first wall on an attachment coating side.

3. The process according to claim 1 whereby a strip comprising an attachment layer, a substrate and the anti-adhesive coating, is applied to the first wall, and in a next step the coat of adhesive is applied on to the anti-adhesive coating.

4. The process according to claim 1 whereby the bag is closed by bonding a second flap extending from the first wall on to the second wall, the coat of adhesive is applied on to the second wall and the anti-adhesive coating is applied on to the first wall, the coat of adhesive and the anti-adhesive coating being joined when the stack is formed.

5. The process according to claim 1 whereby the coat of adhesive is applied downstream of the closing of a bottom of the bag.

6. A machine for manufacturing flexible bags including a tube-forming device for forming a tube from a strip of flexible material, a separation device for separating a portion of the tube at a front of the tube while forming a first flap to a rear of the portion of the tube, the first flap prolonging a first wall of the portion of the tube beyond an end of a second wall adjacent to the first wall, a bag-bottom forming device for forming a bag with each portion of the tube by closing a front of the portion of the tube, and a stacking device for forming a stack of bags, the first wall of a first bag of the stack of bags being against a second wall of an adjacent second bag, the machine comprising a first means of application for applying an anti-adhesive coating on to the first wall of the first bag, and a second means of application for applying a coat of adhesive-to the anti-adhesive coating before the formation of the stack, and the coat of adhesive is transferred on to the second wall of the adjacent second bag when the stack is formed.

* * * * *